United States Patent [19]

Blase

[11] 4,130,244

[45] Dec. 19, 1978

[54] TRACK RAIL SUPPORT

[75] Inventor: Manfred Blase, Essen, Germany

[73] Assignee: Didier Engineering GmbH, Essen, Germany

[21] Appl. No.: 609,148

[22] Filed: Aug. 29, 1975

[30] Foreign Application Priority Data

Sep. 9, 1974 [DE] Fed. Rep. of Germany ..... 2443047

[51] Int. Cl.[2] ..... E01B 3/12

[52] U.S. Cl. ..... 238/24; 238/122

[58] Field of Search ..... 238/24, 26, 42, 109, 238/114, 122, 138, 86, 57, 58, 55, 283, 349

[56] References Cited

U.S. PATENT DOCUMENTS

| | | | |
|---|---|---|---|
| 296,567 | 4/1884 | Holgate et al. | 238/26 |
| 317,665 | 5/1885 | Moxham | 238/26 |
| 1,254,419 | 1/1918 | Livingston | 238/26 |
| 3,088,674 | 5/1963 | Maynier | 238/24 |
| 3,870,230 | 3/1975 | Damy | 238/349 |

FOREIGN PATENT DOCUMENTS

| | | | |
|---|---|---|---|
| 12548 | 7/1909 | France | 238/26 |
| 9789 | 12/1878 | Italy | 238/24 |

*Primary Examiner*—Trygve M. Blix
*Assistant Examiner*—Kenneth W. Noland
*Attorney, Agent, or Firm*—Wenderoth, Lind & Ponack

[57] ABSTRACT

A track rail support includes ties positioned at spaced intervals along a base and supporting track rails. An elongated intermediate carrier is positioned between the ties and each track rail. Secondary track rail supports in the form of block-shaped elements are positioned in contact with the intermediate carrier. Each block-shaped element is positioned above a position midway between two adjacent ties.

11 Claims, 13 Drawing Figures

TRACK RAIL SUPPORT

BACKGROUND OF THE INVENTION

The present invention relates to a track rail support, particularly for use in connection with hopper or charging car tracks on coke oven blocks or batteries, but which also may be used in other installations. More particularly, the present invention relates to such a track rail support including ties spaced from each other in the longitudinal direction of the track rails and supporting the track rails, possibly with a supporting rail interposed therebetween.

Such track rail supports are in general use and, apart from the above mentioned supporting rail, are known, for example in the German Federal Railroads. A substantial disadvantage of such track rail supports is that the transverse forces transmitted by a tie to the base, e.g. the cover of a coke oven block, assumes a maximum value corresponding to the load of a separate wheel when such wheel is situated on the track rail directly above the tie. Consequently, the cover of the coke oven blocks must possess a suitable load carrying capacity, at least in the area of the ties. However, since during basic repairs of a coke oven block runner bricks of a lower thickness are frequently selected for increasing the throughput performance of the block, the runner bricks are subjected to an increased compressive stressing while the transport load remains the same. Should the compressive stressing of the runner bricks remain the same in spite of a reduction in their relative thickness, the load transported thereon would have to be reduced.

It is known that it is possible to reduce the compressive stressing of the cover of a coke oven block, at least in the area of the support points of the track rails, i.e. the ties, while the transport load remains the same, by increasing the number of the wheels provided on a charging car. In this connection, it is known to equip charging cars with, and thus to distribute the weight of the car over, eight wheels instead of four wheels. However, such a modification of charging cars is very expensive, both with regard to availability of materials and to costs.

SUMMARY OF THE INVENTION

With the above discussion in mind, it is an object of the present invention to provide an improved track rail support wherein the maximum stresses transmitted to the base from the support are considerably reduced in comparison with known prior art track rail supports.

The above object is achieved in accordance with the present invention by providing an intermediate carrier between the ties and the track rail, and secondary track rail supports are positioned in contact with the intermediate carrier. The secondary supports are positioned directly above positions which are midway between adjacent ties.

The provision of the track rail support in accordance with the present invention, which can even be provided on existing track rail supports through a relatively simple reconstruction, reduces the maximum amount of concentrated stressing of the cover of the coke oven block situated under the ties to half the value of the concentrated forces transmitted by each wheel when using a conventional track rail support.

In a preferred embodiment of the track rail support of the present invention, the secondary supports are bearing block-type elements. It does not matter whether the arrangement of the load bearing blocks and the components supported by or carrying the load bearing blocks is of one piece or of a number of pieces. The only obvious condition to be met is that such elements must have suitable stability such that the elements are capable of resisting the stresses appearing therein.

In a track rail support which includes a supporting rail, the intermediate carrier and the supporting rail may be interchangeable. Thus, the component used as the intermediate carrier in one case may be employed as the supporting rail in another case, and vice versa. Consequently, a structure in the form of two U-shaped elements may be aligned with the parallel arms thereof spaced from each other and employed as either the intermediate carrier or the supporting rail. Alternatively, the two elements may be aligned with the webs thereof in contact to form a tilted H-shaped element or an I-shaped element and employed as either the intermediate carrier or the supporting rail. Also the I-shaped element may be of a unitary construction.

In order to construct the supporting rail as light as possible, it is preferred to provide such component with reinforcing ribs. In accordance with a further feature of the present invention, the reinforcing ribs are provided on the supporting rail in the areas thereof below the secondary supports, i.e. where such component is subjected to the greatest stress.

The principle of the present invention, i.e. the arrangement of an intermediate carrier and correspondingly arranged secondary supports associated therewith, may be repeated a number of times, whereby it is possible to even further reduce the thickness of the cover of the coke oven block positioned beneath the ties. For instance the ties could extend transversely of a plurality of longitudinal arrangements of the track rail, the intermediate carrier and the blocks.

BRIEF DESCRIPTION OF THE DRAWINGS

Other objects and features of the invention will be made apparent in the following detailed description, with reference to the attached drawings, wherein.

DETAILED DESCRIPTION OF THE INVENTION

Figure 1:
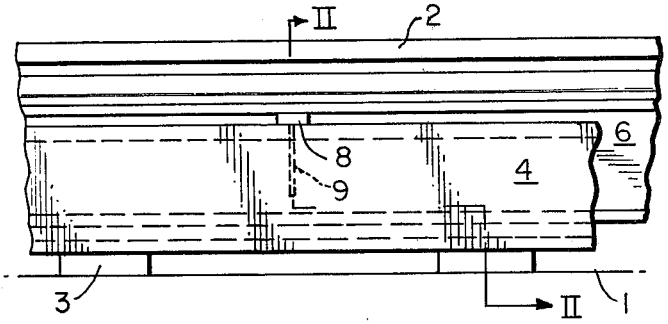
FIG. 1 is a partial longitudinal elevation view of a first embodiment of the track rail support of the invention.
Figure 2:
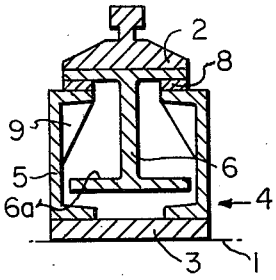
FIG. 2 is a section taken along line II—II of FIG. 1.
Figure 3:
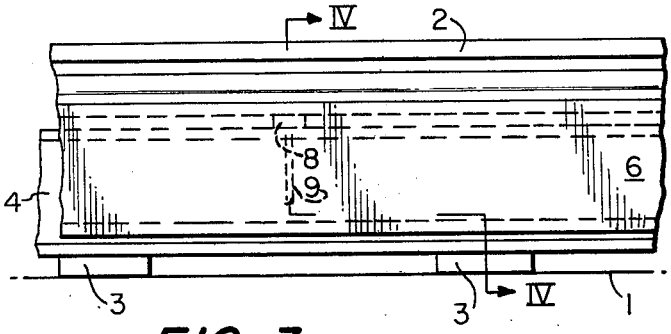
FIG. 3 is a partial longitudinal elevation view of a second embodiment of the track rail support of the invention.
Figure 4:
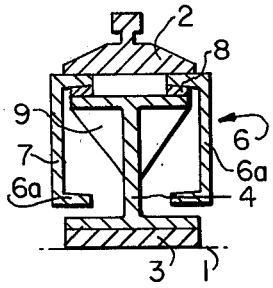
FIG. 4 is a section taken along line IV—IV of FIG. 3.

With reference to FIGS. 1–4, conventional ties 3 are arranged at spaced intervals from one another in the longitudinal direction of a track rail 2 of a track installation. Ties 3 rest on a base, e.g. the upper side of a cover 1 of a coke oven block or battery, which is otherwise not shown in more detail. A supporting rail 4, extending along the length of track rail 2, is arranged immediately above and in contact with ties 3. In the embodiment of FIGS. 1 and 2, the supporting rail 4 consists of two members 5 which are U-shaped and which extend parallel to each other with the parallel arms of the two members spaced from and facing each other. In the embodiment of FIGS. 3 and 4, supporting rail 4 is in the form of a tilted H-shaped element or an I-shaped element.

Between supporting rail 4 and track rail 2 above described, there is provided in accordance with the track rail support of the present invention an intermediate carrier 6. In the embodiment of FIGS. 1 and 2 carrier 6 is in the form of a tilted H-shaped element or an I-shaped element. In the embodiment of FIGS. 3 and 4, carrier 6 is in the form of two members 7 which are U-shaped and which extend parallel to each other in a manner similar to the arrangement of elements 5 discussed above with regard to the embodiment of FIGS. 1 and 2.

Both in the embodiment of FIGS. 1 and 2 and in the embodiment of FIGS. 3 and 4, load bearing blocks 8 are provided between supporting rail 4 and intermediate carrier 6. Bearing blocks 8 are always arranged above a position midway between two adjacent ties 3.

Ribs 9 reinforce supporting rail 4 in the areas thereof below the locations of bearing blocks 8.

Figure 5A:
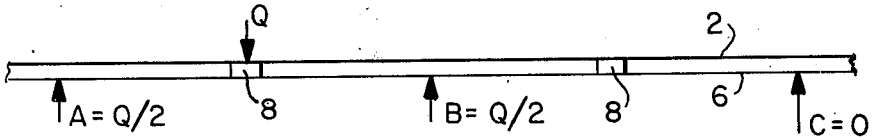
FIGS. 5*a* and 5*b* are schematic representations of the load conditions on a base carrying the track rail support of the invention.
Figure 5B:
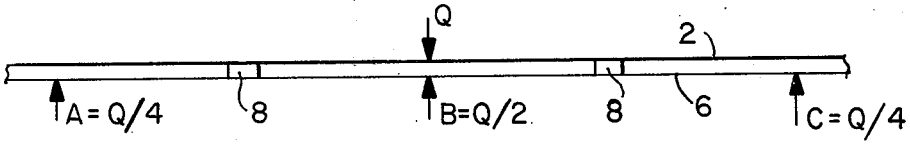

FIGS. 5*a* and 5*b* schematically illustrate how a force Q, exerted on track rail 2 by a charging car wheel, is transmitted to intermediate carrier 6 by means of bearing blocks 8. In the case where the wheel, or corresponding force Q, is situated on track rail 2 directly above a bearing block 8, as is shown in FIG. 5*a*, such force is transmitted to the part of intermediate carrier 6 which is situated between the two ties 3 adjacent to such bearing block 8, the ties being represented in FIG. 5*a* by the arrows A, B and C which symbolize support forces. Under the load conditions shown in FIG. 5*a*, positions A and B each absorb half the load Q, while position C, as well as other tie positions, is entirely free of the load. This means that for practical purposes the ties corresponding to positions A and B each transmit half the wheel load to cover 1 of the coke oven block associated therewith.

If the wheel supported by track rail 2 is positioned somewhere between two adjacent bearing blocks 8, then cover 1 of the coke oven block is subjected to a maximum load in the case where the wheel is positioned precisely above the midpoint between two adjacent bearing blocks 8. This load condition is shown in FIG. 5*b*, and results in half of the total wheel load being absorbed at position B, situated perpendicularly below the wheel, while the other half of the total wheel load is divided between adjacent positions A and C, i.e. each of adjacent positions A and C absorb one quarter of the total wheel load.

Figure 11:
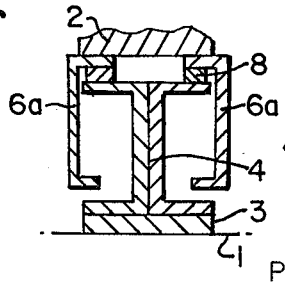
FIG. 11 is a view similar to FIG. 4, but illustrating a further modification of the present invention.

As will be apparent from the above discussion and from FIGS. 2 and 4, the configurations of structures of supporting rail 4 and intermediate carrier 6 are interchangeable. Further, the I-shaped element may be integrally formed, or it may be formed of two U-shaped elements with the webs thereof in contact, as shown in FIG. 11. The interchangeability has no effect on the force distributing characteristics discussed above with regard to FIGS. 5*a* and 5*b*.

Figure 6:
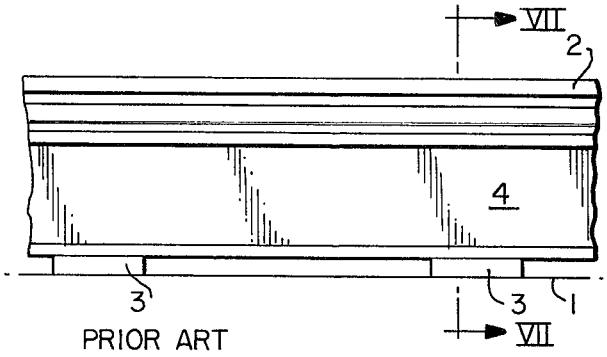
FIG. 6 is a partial longitudinal elevation view of a known prior art track rail support.
Figure 7:
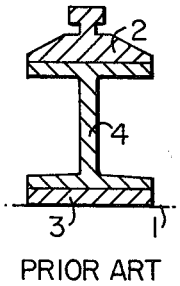
FIG. 7 is a section along line VII—VII of FIG. 6.
Figure 8A:
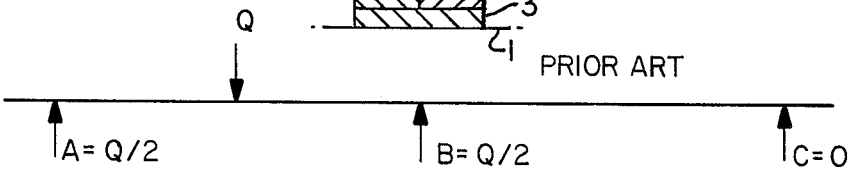
FIGS. 8*a* and 8*b* are schematic representations of the load conditions on a base carrying the known prior art track rail support of FIGS. 6 and 7.
Figure 8B:
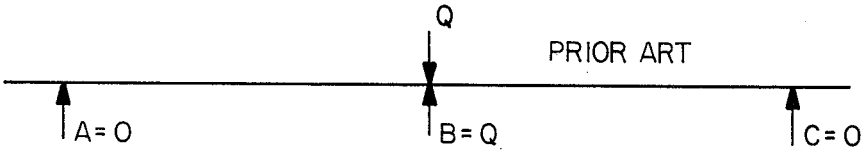

FIGS. 6 to 8 will emphasize the advantages of the above described arrangement of the present invention as compared with known prior art track rail supports. FIGS. 6 and 7 illustrate a conventional track rail support, which consists merely of track rail 2, supporting rail 4 and ties 3, the arrangement being positioned on the upper side of cover 1 of of a coke oven block or battery. The distribution of the loading forces occurring in connection with such a known track rail support is illustrated in FIGS. 8*a* and 8*b*, in a manner similar to that discussed above with regard to FIGS. 5*a* and 5*b*. From a comparison between FIGS. 5*b* and 8*b*, it will been seen that the maximum force transferred to the cover 1 of a coke oven block in a conventional track rail support is exactly twice as large as the corresponding maximum force transferred in accordance with the track rail support of the present invention.

Figure 9:
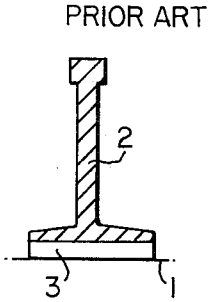
FIG. 9 is a section through a further known prior art track rail support.

FIG. 9 illustrates a second type of conventional prior art track rail support wherein track rail 2 having a high vertical portion rests directly on ties 3. A separate supporting rail, such as supporting rail 4 of FIGS. 6 and 7, is omitted due to the high vertical portion of the track rail 2 and the resultant greater resistance against bending between two adjacent ties. The principle of the present invention may be applied to a conventional track rail support such as shown in FIG. 9. For instance, with reference to FIG. 10, intermediate carrier 6 is provided in two parts which rests on ties 3, with blocks 8 between carrier 6 and track rail 2.

Figure 10:
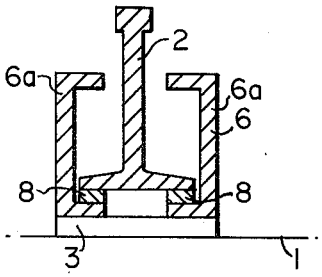
FIG. 10 is a section, similar to FIGS. 2 and 4, through a track rail support of the type shown in FIG. 9, but modified in accordance with the invention.

The arms 6*a* of intermediate carrier 6 which, as shown in FIGS. 2, 4 and 10, are not directly supported and which could thus be omitted from this point of view, are employed for increasing the rigidity of portions of the carrier between blocks 8.

The components 8, designated above as load bearing blocks, are not normally to be considered as mineral or synthetic stone elements. Rather and particularly in the case of relatively great loads, components 8 are in the form of steel plates or small steel blocks or the like.

It will be apparent that various modifications may be made to the above described specific structural arrangements without departing from the scope of the invention.

What is claimed is:

1. In a track rail support, particularly for transporting charging cars over coke oven blocks or batteries, said track rail support being of the type including a plurality of ties positioned at spaced intervals on a base and at least one elongated track rail supported by said ties, said ties extending transversely across the entire width of the track rail support, the improvement comprising:

an elongated intermediate carrier positioned between said ties and said track rail, said elongated intermediate carrier extending longitudinally throughout the entire length of said track rail;

a plurality of secondary track rail supports positioned in contact with said intermediate carrier; and said secondary track rail supports being spaced from each other in the longitudinal direction of said track rail, each said secondary track rail support being positioned above a position midway between two adjacent of said ties.

2. The improvement claimed in claim 1, wherein said secondary track rail supports are load bearing blocks.

3. The improvement claimed in claim 2, wherein said intermediate carrier rests directly on said ties, and said blocks directly support said track rail and contact said intermediate carrier.

4. The improvement claimed in claim 3, wherein said intermediate carrier comprises two U-shaped elements each having two parallel arms joined by a web, said two U-shaped elements being spaced from and extending parallel to each other with said webs extending vertically and said arms facing each other, said blocks resting on the lower of said arms of each of said U-shaped elements.

5. The improvement claimed in claim 2, further comprising an elongated supporting rail resting directly on said ties, said blocks directly supporting said intermediate carrier and resting on said supporting rail, and said track rail resting directly on said intermediate carrier.

6. The improvement claimed in claim 5, wherein said supporting rail has reinforcing ribs below the positions of contact of said blocks with said supporting rail.

7. The improvement claimed in claim 5, wherein one of said intermediate carrier and said supporting rail is in the form of an I-shaped element, and the other of said intermediate carrier and said supporting rail is in the form of two U-shaped elements each having two parallel arms joined by a web, said two U-shaped elements being spaced from and extending parallel to each other with said webs extending vertically and said arms facing each other.

8. The improvement claimed in claim 7, wherein said I-shaped element is of integral construction.

9. The improvement claimed in claim 7, wherein said I-shaped element is formed of two U-shaped elements having webs in abutting contact.

10. The improvements claimed in claim 7, wherein said supporting rail is in the form of said two U-shaped elements, and said intermediate carrier is in the form of said I-shaped element.

11. The improvement claimed in claim 7, wherein said intermediate carrier is in the form of said two U-shaped elements, and said supporting rail is in the form of said I-shaped element.

* * * * *